US009908009B1

(12) United States Patent
Lee

(10) Patent No.: US 9,908,009 B1
(45) Date of Patent: Mar. 6, 2018

(54) STRING CLAMPING DEVICE OF THREADING MACHINE FOR RACKET

(71) Applicant: Min Wei Lee, Taichung (TW)

(72) Inventor: Min Wei Lee, Taichung (TW)

( * ) Notice: Subject to any disclaimer, the term of this patent is extended or adjusted under 35 U.S.C. 154(b) by 0 days.

(21) Appl. No.: 15/414,645

(22) Filed: Jan. 25, 2017

(51) Int. Cl.
*A63B 51/14* (2006.01)

(52) U.S. Cl.
CPC ..... *A63B 51/14* (2013.01)

(58) Field of Classification Search
CPC ..... A63B 51/00; A63B 51/14
See application file for complete search history.

(56) References Cited

U.S. PATENT DOCUMENTS 4,874,170 A * 10/1989 Zech ..... A63B 51/14 24/516
6,093,121 A * 7/2000 Bishop ..... A63B 51/14 473/557
6,280,355 B1 * 8/2001 Hauptman ..... A63B 51/00 473/557
6,533,687 B1 * 3/2003 Lee ..... A63B 51/14 473/557
7,252,606 B1 * 8/2007 Lee ..... A63B 51/14 473/555
2001/0037546 A1 * 11/2001 Tsuchida ..... A63B 51/14 29/241
2010/0308522 A1 * 12/2010 Lee ..... A63B 51/14 269/90

* cited by examiner

*Primary Examiner* — Raleigh W Chiu

(57) ABSTRACT

A string clamping device of a threading machine for a racket contains: a clamp unit, a tightening unit, an adjustment disc, a connection column, and a fixing structure. The clamp unit includes a body, a locking seat, and two first springs. The body has multiple first paws, the locking seat has multiple second paws, and among the multiple first and second paws is defined a gap of the clamp unit. The tightening unit includes an abutting block and an operation handle, the body has a first protrusion with a first through orifice, and the adjustment disc includes multiple teeth, wherein between any two adjacent teeth is defined a recess. The fixing structure includes an affix member, a coupling shaft, a second spring, a screwing element, and a support part, wherein the affix member has a retaining portion, and the second spring contacts with a drive tab of the support part.

2 Claims, 5 Drawing Sheets

STRING CLAMPING DEVICE OF THREADING MACHINE FOR RACKET

FIELD OF THE INVENTION

The present invention relates to a threading machine for a racket, and more particularly to a string clamping device of the threading machine.

BACKGROUND OF THE INVENTION

A conventional string clamping device of a threading machine for a racket contains: a clamp unit, a tightening unit, a connection column, and an adjustment member.

The clamp unit includes a body and a fixing seat which are configured to clamp two first springs, wherein the tightening unit has an operation handle, and the tightening unit clamps two steel balls and a second spring so as to abut against the fixing seat of the clamp unit. The clamp unit includes two adjustment bolts configured to adjust the fixing seat to move forward and backward, the connection column connects the clamp unit and the tightening unit together, and the adjustment member rotates into the clamp unit so as to adjust tightness between the body of the clamp unit and the fixing seat.

Between the body and the fixing seat is defined a gap configured to accommodate strings. The adjustment member is rotated so as to drive the connection column to actuate a locking block of the tightening unit, and the locking block moves so as to adjust a width of the gap based on a diameter of the strings.

However, as threading the strings onto the racket, the strings are clamped by the body and the fixing seat, a resistance force of the strings is against the body and the fixing seat, the adjustment member and the connection column move, and the width of the gap expands, hence the adjustment member is rotated repeatedly so as to adjust the width of the gap troublesomely.

The present invention has arisen to mitigate and/or obviate the afore-described disadvantages.

SUMMARY OF THE INVENTION

The primary objective of the present invention is to provide a string clamping device of a threading machine for a racket which contains a fixing structure configured to fix an adjustment disc as threading strings.

To obtain the above objective, a string clamping device of a threading machine for a racket provided by the present invention contains: a clamp unit, a tightening unit, an adjustment disc, a connection column, and a fixing structure.

The clamp unit includes a body, a locking seat relative to the body, and two first springs defined between the body and the locking seat. The body has multiple first paws arranged on a top thereof, and the locking seat has multiple second paws formed on a top thereof and located adjacent to the multiple first paws, wherein among the multiple first paws and the multiple second paws is defined a gap of the clamp unit.

The tightening unit includes an abutting block and an operation handle, the abutting block is proximate to a rear end of the locking seat, and a front end of the operation handle rotatably connects with the abutting block and contacts with a rear end of the body.

The adjustment disc rotatably connects with a front end of the body, the connection column rotatably inserts through the body and the locking seat, and a front end of the connection column screws with the adjustment disc, the connection column is rotatably connected with the abutting block.

The body has a first protrusion extending outward from a front rim of the body, the first protrusion has a first through orifice passing therethrough, and the adjustment disc includes multiple teeth arranged around a peripheral side thereof, wherein between any two adjacent teeth is defined a recess.

The fixing structure includes an affix member, a coupling shaft, a second spring, a screwing element, and a support part, wherein the coupling shaft rotatably connects with the body via the affix member so that the affix member revolves along the coupling shaft, and the affix member has a retaining portion, wherein a distal end of the retaining portion retains with one of recesses and is biased against one of the multiple teeth adjacent to the first protrusion, the adjustment disc rotates in a single direction so that the screwing element screws into the first through orifice.

The support part is accommodated in the first through orifice and abuts against the screwing element, a first end of the second spring abuts against the retaining portion of the affix member, and a second end of the second spring moves into the first through orifice and fits on the support part, wherein the second spring contacts with a drive tab of the support part proximate to the screwing element so that the second spring pushes the retaining portion to contact with the adjustment disc.

DETAILED DESCRIPTION OF THE PREFERRED EMBODIMENTS

Figure 1:
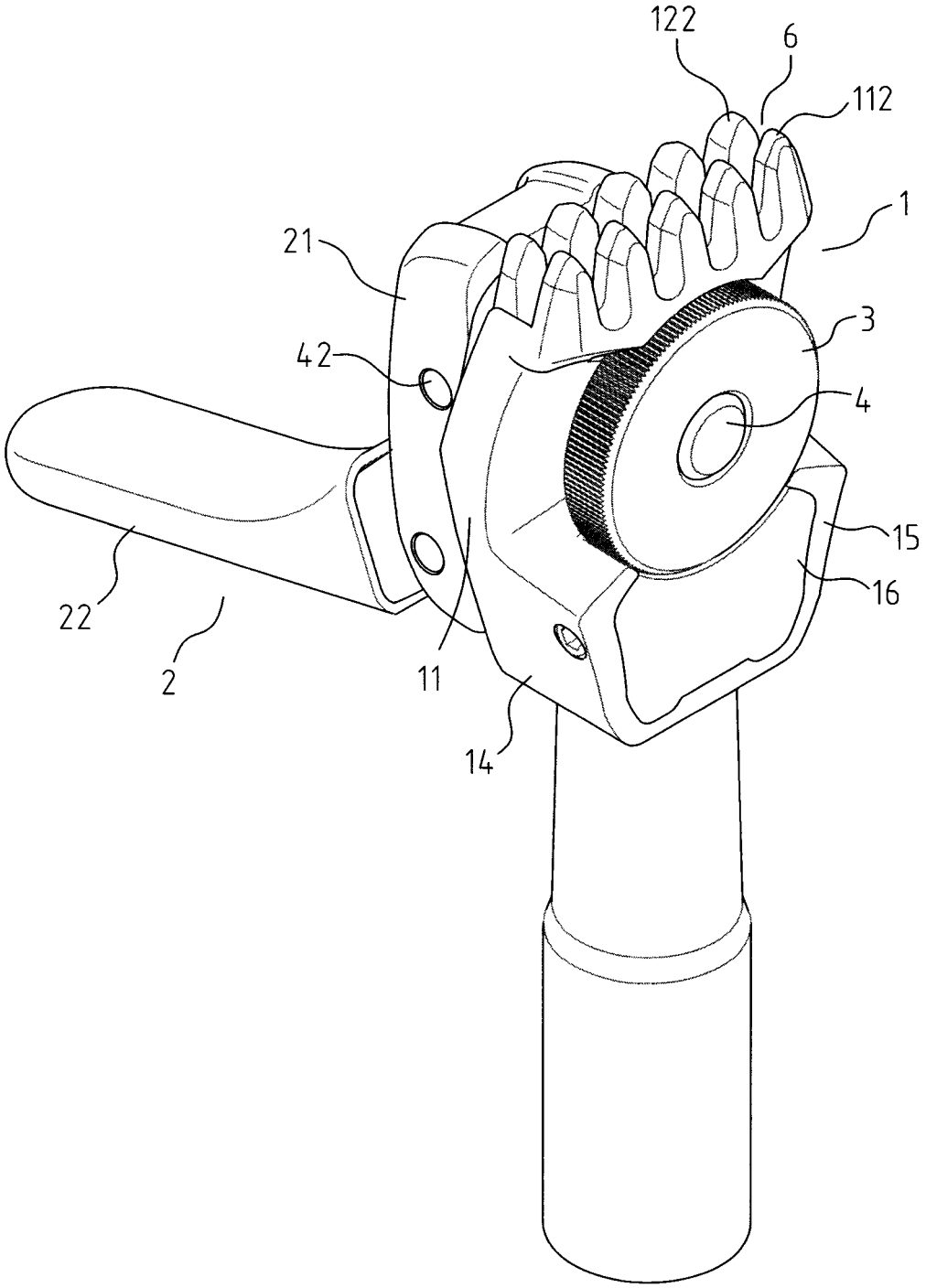
FIG. 1 is a perspective view showing the assembly of a string clamping device of a threading machine for a racket according to a preferred embodiment of the present invention.
Figure 2:
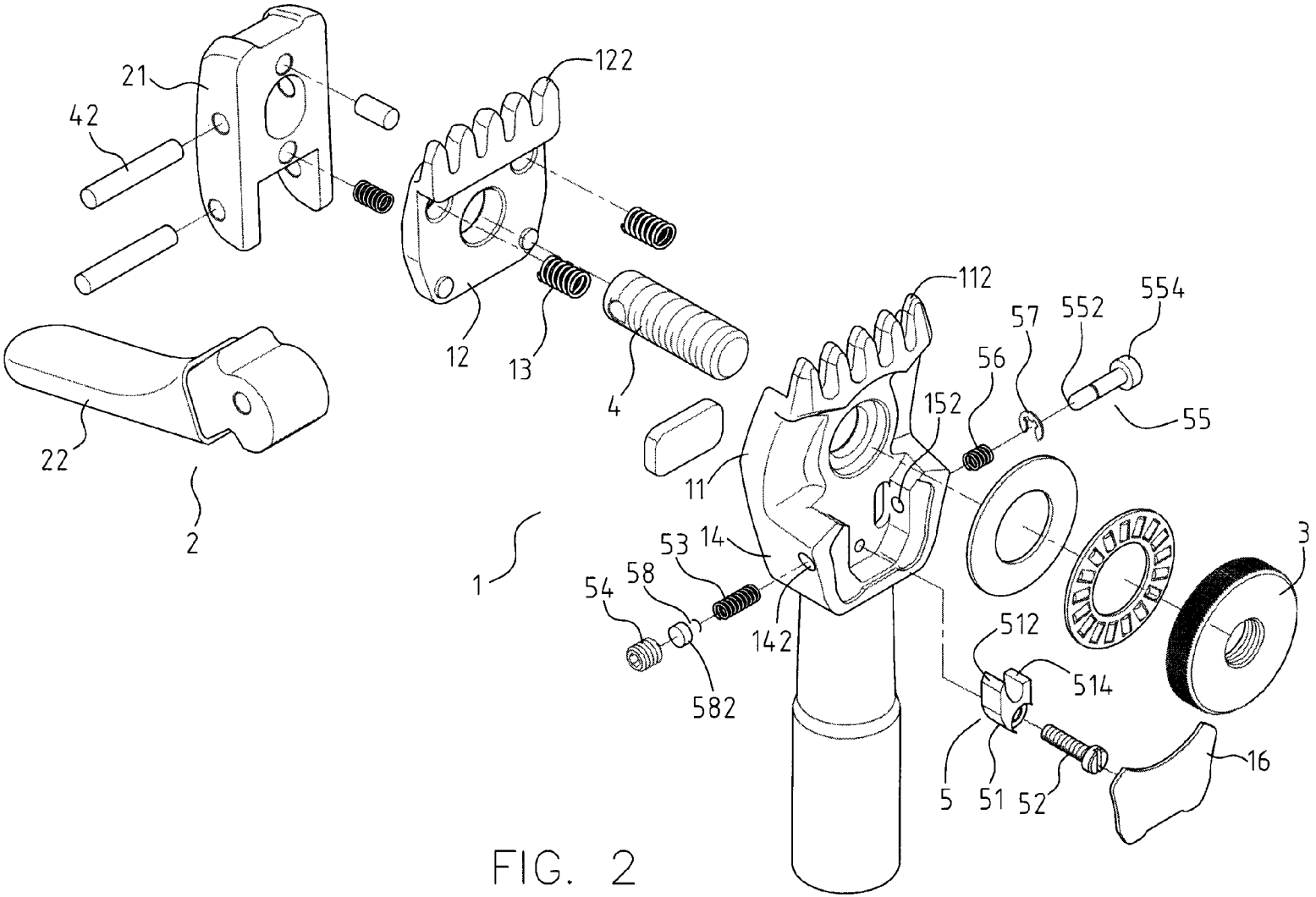
FIG. 2 is a perspective view showing the exploded components of the string clamping device of the threading machine for the racket according to the preferred embodiment of the present invention.
Figure 3:
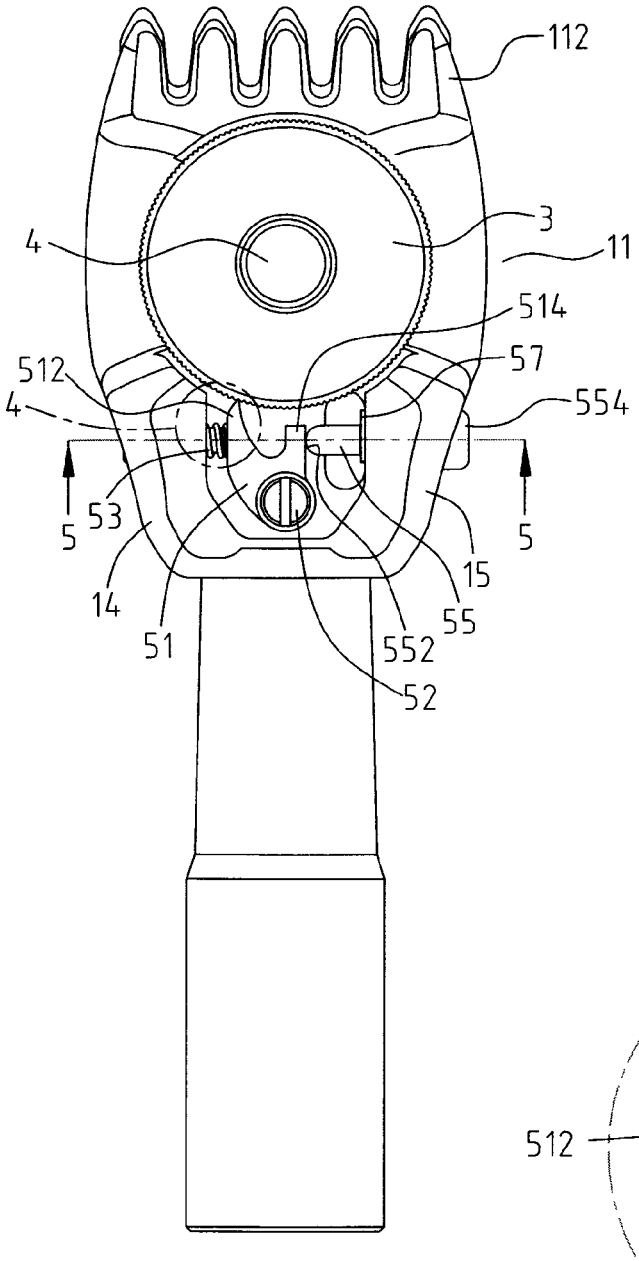
FIG. 3 is a side plane view showing the operation of the string clamping device of the threading machine for the racket according to the preferred embodiment of the present invention.
Figure 4:
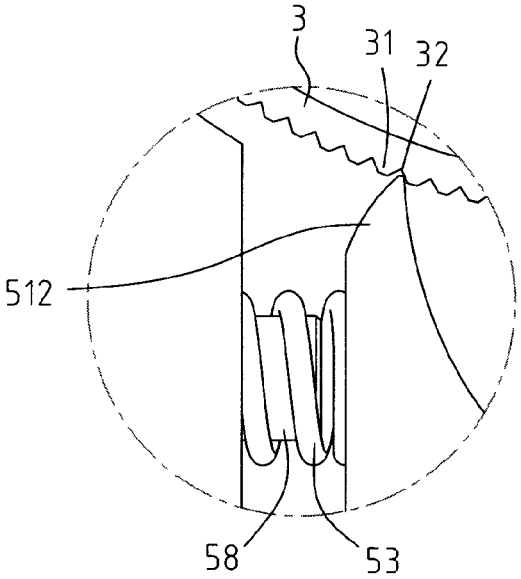
FIG. 4 is another side plane view showing the operation of the string clamping device of the threading machine for the racket according to the preferred embodiment of the present invention.
Figure 5:
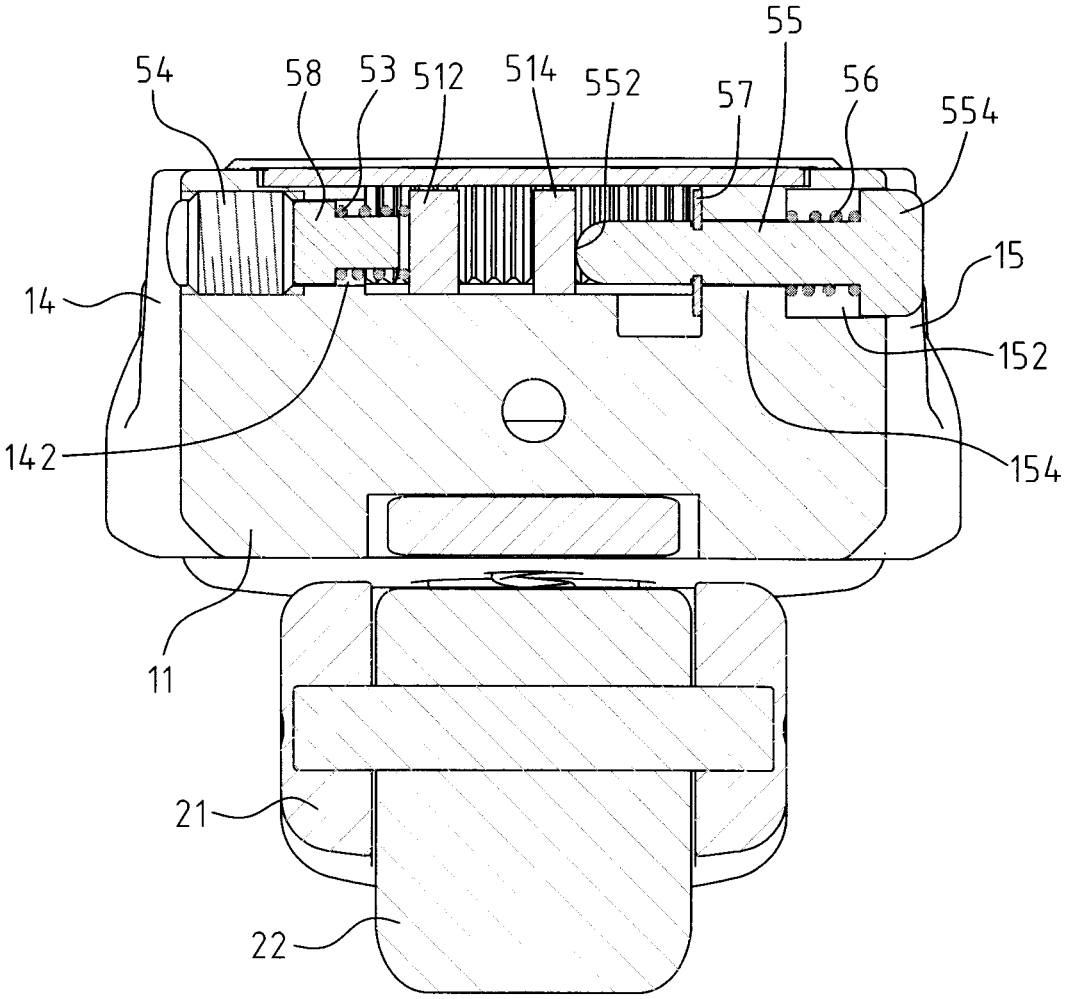
FIG. 5 is a cross sectional view taken along the line of 5-5 of FIG. 3.

With reference to FIGS. 1 and 2, a string clamping device of a threading machine for a racket according to a preferred embodiment of the present invention comprises: a clamp unit 1, a tightening unit 2, an adjustment disc 3, a connection column 4, and a fixing structure 5.

The clamp unit 1 includes a body 11, a locking seat 12 relative to the body 11, and two first springs 13 defined between the body 11 and the locking seat 12. The body 11 has multiple first paws 112 arranged on a top thereof, and the locking seat 12 has multiple second paws 122 formed on a top thereof and located adjacent to the multiple first paws 112, wherein among the multiple first paws 112 and the multiple second paws 122 is defined a gap 6 so that strings (not shown) insert through the gap 6, and the multiple first and second paws 112, 122 clamp the strings respectively.

The tightening unit 2 includes an abutting block 21 and an operation handle 22, wherein the abutting block 21 is proximate to a rear end of the locking seat 12, and a front end of the operation handle 22 rotatably connects with the abutting block 21 and contacts with a rear end of the body 11.

The adjustment disc 3 rotatably connects with a front end of the body 11.

The connection column 4 rotatably inserts through the body 11 and the locking seat 12, and a front end of the connection column 4 screws with the adjustment disc 3. The connection column 4 is rotatably connected with the abutting block 21 by way of a bolt 42, wherein when the operation handle 22 is pushed downwardly, the abutting block 21 rotates along the bolt 42, and the abutting block 21 abuts against and drives the locking seat 12 to move toward the body 11 so that the multiple first and second paws 112, 122 clamp the strings.

Referring further to FIGS. 2 to 5, the body 11 has a first protrusion 14 extending outward from a front rim of the body 11, a second protrusion 15 opposite to the first protrusion 14, and a cap 16 defined between the first protrusion 14 and the second protrusion 15, wherein the first protrusion 14 has a first through orifice 142 passing therethrough, the second protrusion 15 has a second through orifice 152 passing therethrough, and the second through orifice 152 has a limitation portion 154 formed therein adjacent to the first protrusion 14. The adjustment disc 3 includes multiple teeth 31 arranged around a peripheral side thereof, wherein between any two adjacent teeth 31 is defined a recess 32.

The fixing structure 5 includes an affix member 51, a coupling shaft 52, a second spring 53, a screwing element 54, a push post 55, a third spring 56, and a support part 58. The affix member 51 is fixed between the first protrusion 14 and the second protrusion 15, the coupling shaft 52 rotatably connects with the body 11 via the affix member 51 so that the affix member 51 revolves along the coupling shaft 52, and the affix member 51 has a retaining portion 512 and a pushing portion 514, wherein the retaining portion 512 is adjacent to the first protrusion 14, the pushing portion 514 is proximate to the second protrusion 15, a distal end of the retaining portion 512 retains with one of recesses 32 and is biased against one of the multiple teeth 31 adjacent to the first protrusion 14. The adjustment disc 3 rotates in a clockwise direction so that the connection column 4 moves backward, and the screwing element 54 screws into one end of the first through orifice 142 of the body 11. The support part 58 is accommodated in the first through orifice 142 and abuts against the screwing element 54, a first end of the second spring 53 abuts against the retaining portion 512 of the affix member 51, and a second end of the second spring 53 moves into the first through orifice 142 and fits on the support part 58, wherein the second spring 53 contacts with a drive tab 582 of the support part 58 proximate to the screwing element 54 so that the second spring 53 pushes the retaining portion 512 to contact with the adjustment disc 3. After the screwing element 54 is rotated to urge the second spring 53 to push the retaining portion 512, the push post 55 rotatably connects with the second through orifice 152, wherein a first end of the push post 55 is an engagement segment 552, and a second end of the push post 55 is a head segment 554. The engagement segment 552 is biased against the pushing portion 514 of the affix member 51, the head segment 554 of the push post 55 extends out of the body 11, and the push post 55 has a C-ring 57 defined between the engagement segment 552 and the second protrusion 15, hence the push post 55 is fixed in the second protrusion 15, the third spring 56 is housed in the second through orifice 152, and the push post 55 inserts through the third spring 56, wherein a first end of the third spring 56 abuts against the limitation portion 154, and a second end of the third spring 56 contacts with the head segment 554.

The affix member 51 limits a rotation direction of the adjustment disc 3 by using the retaining portion 512, wherein as threading the strings, the connection column 4 moves toward a front end of the body 11, and a width of the gap 6 does not increase as resistance force of the strings expands.

As desiring to clamp the strings of a small diameter, the adjustment disc 3 is revolved so that the connection column 4 moves toward the front end of the body 11, and the width of the gap 6 decreases so as to thread the strings of the small diameter matingly.

Figure 6:
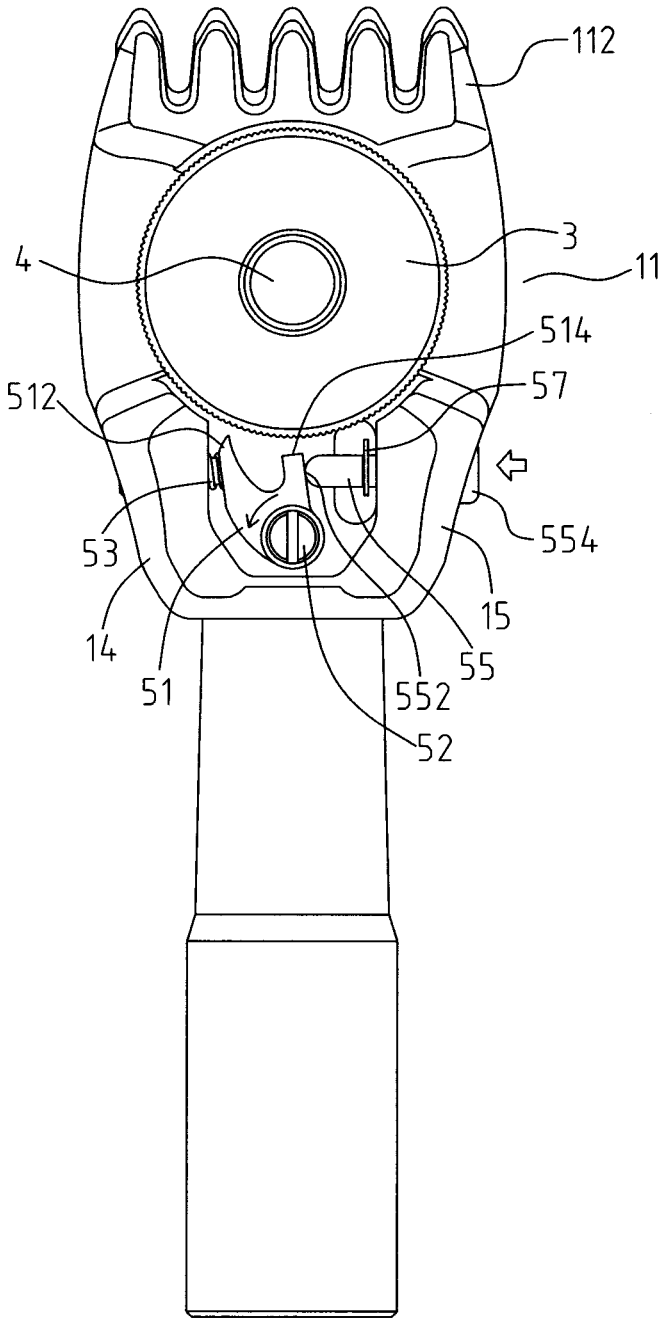
FIG. 6 is also another side plane view showing the operation of the string clamping device of the threading machine for the racket according to the preferred embodiment of the present invention.

As illustrated in FIG. 6, the head segment 554 of the push post 55 is pressed so that the push post 55 pushes the affix member 51 to rotate in a counterclockwise direction along the coupling shaft 52, and the retaining portion 512 moves away from the adjustment disc 3, thus removing the affix member 51 from the adjustment disc 3 and increasing the width of the gap 6 by rotating the adjustment disc 3.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A string clamping device of a threading machine for a racket comprising: a clamp unit, a tightening unit, an adjustment disc, a connection column, and a fixing structure;

wherein the clamp unit includes a body, a locking seat relative to the body, and two first springs defined between the body and the locking seat, the body has multiple first paws arranged on a top thereof, and the locking seat has multiple second paws formed on a top thereof and located adjacent to the multiple first paws, wherein among the multiple first paws and the multiple second paws is defined a gap of the clamp unit;

wherein the tightening unit includes an abutting block and a operation handle, the abutting block is proximate to a rear end of the locking seat, and a front end of the operation handle rotatably connects with the abutting block and contacts with a rear end of the body;

wherein the adjustment disc rotatably connects with a front end of the body, the connection column rotatably inserts through the body and the locking seat, and a front end of the connection column screws with the adjustment disc, the connection column is rotatably connected with the abutting block;

wherein the body has a first protrusion extending outward from a front rim of the body, the first protrusion has a first through orifice passing therethrough, and the adjustment disc includes multiple teeth arranged around a peripheral side thereof, wherein between any two adjacent teeth is defined a recess; and wherein the fixing structure includes an affix member, a coupling shaft, a second spring, a screwing element, and a support part, wherein the coupling shaft rotatably connects with the body via the affix member so that the affix member revolves along the coupling shaft, and the affix member has a retaining portion, wherein a distal end of the retaining portion retains with one of recesses and is biased against one of the multiple teeth adjacent to the first protrusion, the adjustment disc rotates in a single direction so that the screwing element screws into the first through orifice;

wherein the support part is accommodated in the first through orifice and abuts against the screwing element, a first end of the second spring abuts against the retaining portion of the affix member, and a second end of the second spring moves into the first through orifice and fits on the support part, wherein the second spring contacts with a drive tab of the support part proximate to the screwing element so that the second spring pushes the retaining portion to contact with the adjustment disc.

2. The string clamping device as claimed in claim 1, wherein the body has a second protrusion opposite to the first protrusion, the second protrusion has a second through orifice passing therethrough, and the second through orifice has a limitation portion formed therein adjacent to the first protrusion;

wherein the fixing structure includes a push post and a third spring, the affix member is fixed between the first protrusion and the second protrusion, and the affix member has a pushing portion, wherein the retaining portion is adjacent to the first protrusion, the pushing portion is proximate to the second protrusion, and the push post rotatably connects with the second through orifice, wherein a first end of the push post is an engagement segment, and a second end of the push post is a head segment, the engagement segment is biased against the pushing portion of the affix member, the head segment of the push post extends out of the body, and the push post has a C-ring defined between the engagement segment and the second protrusion, hence the push post is fixed in the second protrusion, the third spring is housed in the second through orifice, and the push post inserts through the third spring, wherein a first end of the third spring abuts against the limitation portion, and a second end of the third spring contacts with the head segment.

* * * * *